United States Patent [19]

Kincaid

[11] Patent Number: 5,052,311

[45] Date of Patent: Oct. 1, 1991

[54] ZERO-CLEARANCE FIREBOX

[76] Inventor: Patricia A. Kincaid, 815 E. Palace Ave., #30, Santa Fe, N. Mex. 87501

[21] Appl. No.: 458,075

[22] Filed: Dec. 28, 1989

[51] Int. Cl.[5] ..... F24B 1/18

[52] U.S. Cl. ..... 126/500; 126/515; 126/531; 110/235

[58] Field of Search ..... 126/531, 515, 500, 544, 126/545; 110/235, 248

[56] References Cited

U.S. PATENT DOCUMENTS

| | | | |
|---|---|---|---|
| 2,821,975 | 2/1958 | Thulman | 126/531 |
| 4,153,036 | 5/1979 | Billmeyer et al. | 126/515 |
| 4,177,793 | 12/1979 | Johnson | 126/531 |
| 4,384,565 | 5/1983 | Scholz et al. | 126/500 |
| 4,422,438 | 12/1983 | Scholz et al. | 126/500 |
| 4,603,682 | 8/1986 | Maziasz | 126/500 |
| 4,607,611 | 8/1986 | Rice et al. | 126/531 |
| 4,700,687 | 10/1987 | Bailey et al. | 126/500 |
| 7,270,940 | 1/1942 | Elmore | 126/531 |

*Primary Examiner*—Henry C. Yuen
*Attorney, Agent, or Firm*—Matthew F. Jodziewicz

[57] ABSTRACT

A zero-clearance firebox with a much simplified construction enables efficient air exchange directly through one opening in which solid combustible materials are placed. The firebox has a metal inner shell and an outer shell of lighter gage metal incorporating a plurality of insulating materials in proximity with the outer and inner shells, including a ceramic blanket, rigid insulation, dead air space, and refractory brick. The firebox can be configured into a rectangle, a wedge or a semicircle for placement into a corner or along a wall of a room. The firebox can easily be adapted for use with liquid fuels such as natural gas, propane, etc. Finishing materials can be attached to the firebox to give the appearance of masonry or adobe.

7 Claims, 3 Drawing Sheets

ZERO-CLEARANCE FIREBOX

BACKGROUND OF THE INVENTION

This invention relates to a zero-clearance firebox which may be used with either solid fuels, particularly wood, or liquid fuels, such as natural gas. A zero-clearance firebox has outer surfaces which may be placed in direct contact with combustible building materials, and as such may be placed against a wall. The firebox disclosed herein can be used in both new construction and remodeling.

Many zero-clearance fireplaces are disclosed in the prior art.

U.S. Pat. No. 4,607,611 to J. S. Rice et al., discloses a solid fuel burning stove enclosed in a metal box. The exterior walls of the stove, which is identified as a Trailmaster 4NI, manufactured by Appalachian Stove, is blanketed with thermal insulation which may be a ceramic fiber. The stove is fitted into a metal box, the inner surfaces of which are also lined with thermal insulation. A metal shield is positioned between the stove and the metal box which at least partially surrounds the stove, to create air spaces between the insulation on the metal box and the shield as well as between the shield and the insulation on the exterior walls of the stove.

Another zero-clearance fireplace, disclosed in U.S. Pat. No. 4,287,871 to G. Schumann et al., consists, essentially, of three concentric metal boxes with air spaces therebetween. The inner metal box is the firebox which is surrounded by a second metal box to define an air space for the circulation of air to be warmed. The outer surface of the second metal box is covered with a sheath of insulation material. A third metal box surrounds the second metal box on the sides, back and top. Cool room air circulates between the second metal box and the third metal box to cool the fireplace.

U.S. Pat. No. 4,169,458 to W. S. Shaw, also discloses what is described as a zero-clearance fireplace which, in cross section, also consists of three concentric metal boxes. The device includes a conventional single walled metal firebox having closeable doors and a flue adopted to communicate with a chimney, enclosed within two metal boxes which define passages for the circulation of air, whereby heat is exchanged between the walls of the metal boxes and the circulating air so that the outer surface of the outermost box remains sufficiently cool to permit installation adjacent combustible structural members. In an alternative embodiment an additional chamber is provided, surrounding all the aforementioned chambers, which can provide a dead air insulating space.

U.S. Pat. No. 4,153,036 to T. F. Billmeyer et al., discloses another complicated metal manufactured fireplace. The fireplace includes a firebox at least partially surrounded by a housing to define an air space therebetween which has a relatively low air inlet and a relatively high air outlet. The firebox is constructed of metal walls sandwiching refractory block. The outer housing is also constructed of refractory block sandwiched between metal walls.

A zero-clearance wood burning stove is disclosed in U.S. Pat. No. 4,369,761 to C. S. Burnette. The stove includes three distinct wall structures, defining an inner most combustion chamber 12, an intermediate air circulating chamber and an outer most chamber which has mineral wool insulation therein.

Finally, U.S. Pat. No. 2,875,747 to W. G. Fish discloses a prefabricated fireplace of metal sheets and "cementitious" panels. The firebox of the fireplace is formed of spaced sheets of metal, having an air space there between.

As can be seen from the foregoing, all are relatively complicated structures with at least three boxes, some of which define a tortious path of air circulation in an attempt to cool the air within a mid-chamber and warm the air in the room. None provide for a direct and simple exchange of warmed air with cooled air through a single opening in a zero-clearance fireplace. None provide for the simple finishing techniques to accept plaster or stucco to accommodate fashionable architectural styles, such as the southwestern United States adobe style.

It is thus an object of the present invention to provide a zero-clearance firebox of much simpler construction, which can be installed in direct contact with combustible building materials, either along a wall or situated in a corner.

Yet another object of the invention is to provide a zero-clearance firebox that has an efficient hot air/cool air exchange rate.

It is still another object of the invention to provide a zero-clearance firebox that can accept either solid or liquid fuels.

It is another object of the invention to provide a firebox to which additional materials can be easily attached to form a fireplace of the desired external ornamental configuration.

It is still another object of the invention to provide a firebox with both the insulating capabilities and the appearance of masonry or adobe, but unlike adobe and masonry, and because of its light weight, can be installed on existing floors, without the need for a reinforced support or slab.

It is an object of the invention to provide a firebox with zero-clearance that is easily and quickly installed because there is no waiting for masonry to cure.

It is still another object of the invention to provide a functional zero-clearance firebox that can accommodate flexibility of exterior ornamental design and finishing.

SUMMARY OF THE INVENTION

A firebox of simple construction for use in constructing a fireplace in both new construction and remodeling. The firebox consists of only two concentric metal shells, an inner shell having an inner surface defining the combustion chamber of the firebox and a surrounding outer shell having an outer surface defining the exterior of said firebox. Both shells have top, bottom, and first and second side portions. The top portions have aligned openings for attaching a flue. The respective first side portions also have aligned openings therein which form a firebox opening to permit the insertion of combustible materials and the exchange of warmed air into the room and the cool air to be heated, although an alternative air intake means is available. Insulation material is positioned in the space between the respective second side portions, whereby those portions of the outer surface defined by the second outer side portion may, during installation of the firebox, be placed in contact with combustible construction materials. The insulation material is, preferably, a ceramic blanket having a density of eight pounds and a maximum operating temperature of 2400° Fahrenheit. Insulating material is also placed between the other portions of the two shells. The space between the inner and outer shells is closed to the outside environment. The construction of the outer shell of the firebox permits the attachment of non-combustible materials to the outer shell to form a fireplace of the desired external ornamental configuration. Finishing materials, such as plaster, tile or brick, may be easily attached to the outer shell to form the desired exterior finish of the fireplace.

Because of the simple design, the firebox and, hence the finished fireplace, can easily have configurations other than the traditional rectangular box type configuration disclosed in the above referenced prior art. Fireboxes having pie-shaped and semi-circular shaped cross-sections are easily constructed.

The simple design of the firebox also permits the installation of additional features such as: a liquid fuel inlet, when it is desired to burn natural gas or propane, etc. instead of solid fuel; fireplace doors; and one or more air inlets to permit the use of outside air during the combustion process. Further, spacers or stand-offs can be provided on the exterior surface of the second side portion and bottom portion to space the firebox from combustible construction materials and, in the case of the bottom portion to create a plenum chamber below the firebox. The plenum chamber can be connected to a source of outside air and connected to the combustion chamber via suitable ducts.

DETAILED DESCRIPTION

Figure 1:
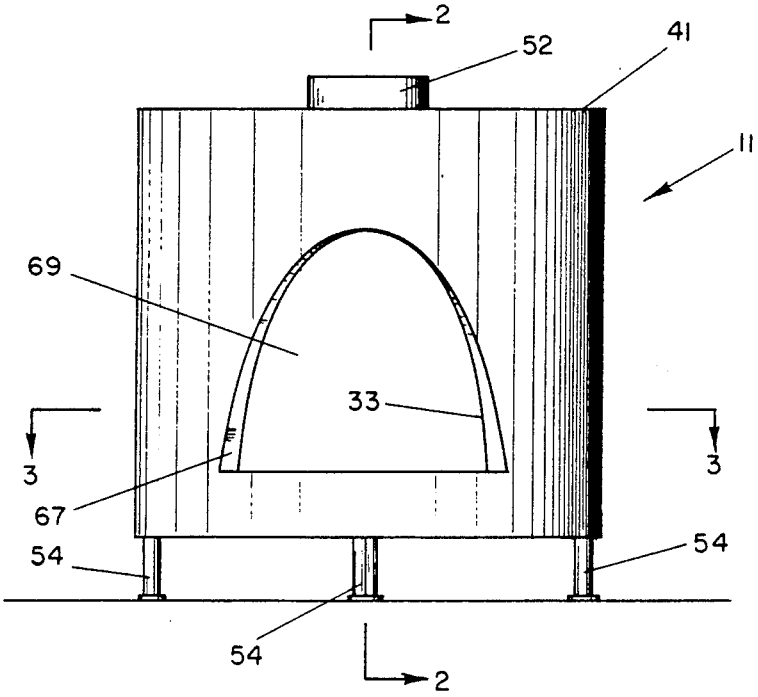
FIG. 1 is the front view of the firebox according to the present invention.
Figure 2:
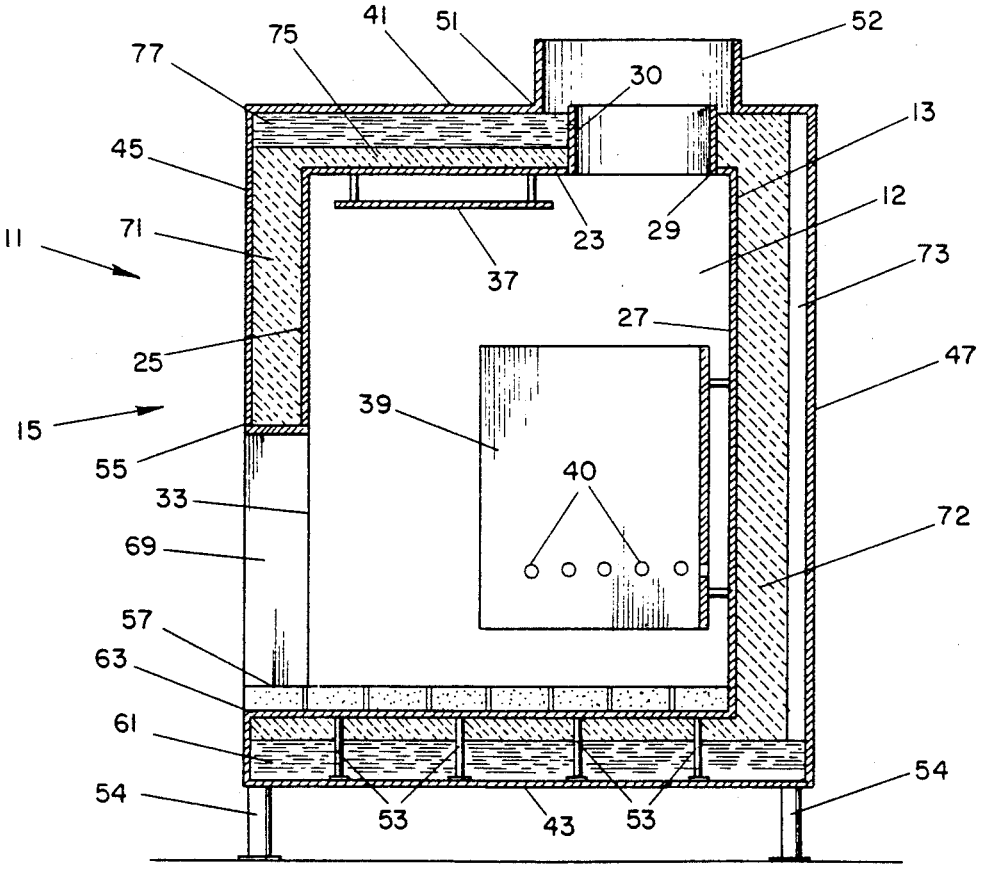
FIG. 2 is an enlarged cross-sectional view of the firebox of FIG. 1, taken along lines 2—2.
Figure 3:
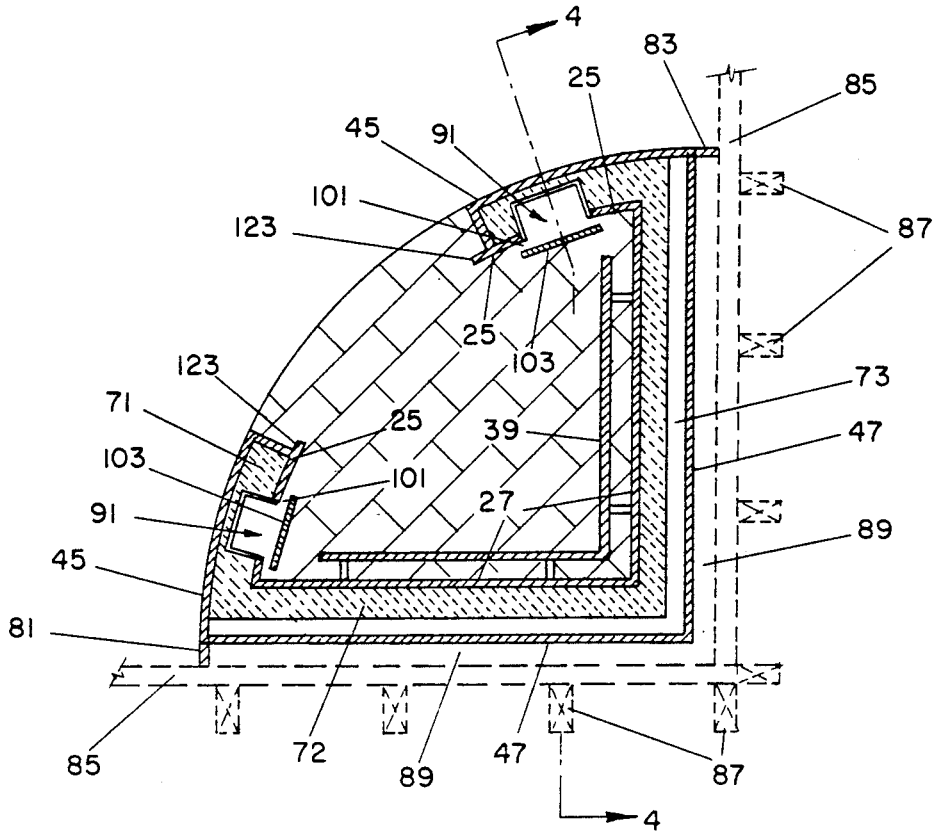
FIG. 3 is another enlarged cross-sectional view of the firebox of FIG. 1, taken along lines 3—3.

With reference to the drawings and more specifically to FIG. 2, firebox 11 includes an inner shell 13 and an outer shell 15. Inner shell 13 is, preferably, formed of ten gauge steel, the inner surfaces of which define the combustion chamber 12. Shell 13 includes a bottom portion 21, a top portion 23, a front or first side portion 25 and a back or second side portion 27. Top portion 23, which in FIGS. 1 and 3 is pie-shaped, has an opening 29 therein, to which is secured an inner flue support ring 30. Bottom portion 21 is also a solid pie-shaped sheet of metal. Front side portion 25 has an opening therein, defined by an arcuate shaped cut-out 33, more clearly shown in FIG. 1. Back side portion 27 is, as is evident from FIG. 3, V-shaped. Inner shell 13 is, preferably, assembled by continuous welding.

Mounted within shell 13 as best illustrated in FIGS. 2 and 3 are optional baffles 37 and 39, made of heavy gauge metal. Baffle 37 functions to create an airflow pattern, as well as a heat barrier. Similarly, baffle 39 functions to create an upward air flow. A plurality of holes 40 insure that the air flow is on both sides of baffle 39. A damper, not shown, may also be incorporated into the chimney flue to control the flow and the amount of air within the combustion chamber 12.

Outer shell 15 which is preferably formed of sixteen gauge steel and includes a top portion 41, a bottom portion 43, front or first side portion 45 and back or second side portion 47. Top portion 41 includes an opening 51 into which is received outer flue support ring 52 and which, in the assembled firebox, aligns with opening 29. Rings 30 and 52 are dimensioned to support a chimney pipe having an eight inch inner diameter and a ten or twelve inch outer diameter. Bottom portion 43 is a solid, essentially pie-shaped sheet of metal which has a plurality of metal pins 53 projecting therefrom which serve to position inner bottom portion 21 relative to bottom portion 43. Preferably, bottom portion 43 also includes at least three L-shaped legs 54. Front portion 45 has an opening 69 therein defined by arcuate shaped top 55 and flat bottom 57. Outer shell 15 is, preferably, spot welded together.

With reference to FIG. 2, the space between inner bottom 21 and outer bottom 43 is filled with a two inch thick rigid insulation 61 with a rating, i.e., a maximum operating temperature of 1200° Fahrenheit, one of such rigid insulation is sold as CERTAINTEED. This rigid insulation 61 need not be as thick as other insulation because the intensity of the heat is not as great at the bottom of the combustion chamber 12. Positioned between rigid insulation 61 and the outer surface of inner bottom portion 21 is a thick ceramic blanket 63 one inch thick, eight pound density with a rating of 2400° Fahrenheit, such as manufactured and sold by Manville Insulation Co. under the name Cera-Blanket. Positioned in the bottom of the combustion chamber 12, on top of bottom portion 21, is a layer of refractory brick 65. With a continuous fire in firebox 11, the outer surface of bottom portion 43 remains at, approximately, room temperature.

The space between front side portions 25 and 45 is closed by arcuate plate 67, to define an opening 69. The interior space is filled with a ceramic blanket 71, approximately three inches thick, having the same properties as blanket 63. The interior space between back side portions 27 and 47 is filled with an approximately three inches thick thermal blanket 72, again having the same properties as blanket 63. To insure greater insulating properties, the spacing between side portion 27 and 47 may be increased to provide a dead air space 73, as shown in FIGS. 2 and 3.

With reference to FIG. 2, the insulation provided between tops 23 and 41 includes a ceramic blanket 75 one inch thick and rigid insulation 77, having the same properties, respectively, as blanket 63 and rigid insulation 61. The overall combination of blanket 75 and board 77 keeps the outer surface of top portion 41 at, approximately, room temperature.

As is also evident from FIG. 3 outer shell 15 may be provided with projecting tabs or stand-offs 81 and 83 to space back side portion 47 from combustible construction materials such as dry wall 85 and studs 87. This provides an additional air space 89 which, though not required by the design of firebox 11, may be required by local building codes.

Figure 4:
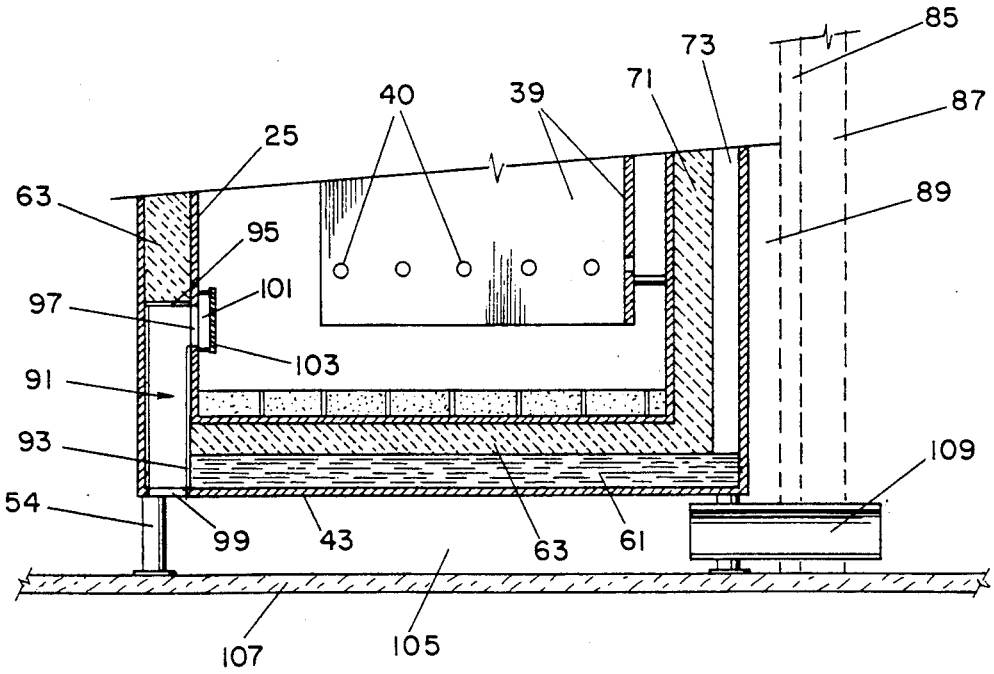
FIG. 4 is a partial sectional view, taken along lines 4—4 of FIG. 3, illustrating the optional air intake ducts.

With reference to FIGS. 3 and 4, the optional fresh air intake system is illustrated. Each intake 91 includes a pair of rectangular tubes 93 having a closed top end 95, a rectangular side opening 97 and a bottom opening 99.

Each opening 97 is aligned with a rectangular opening 101 in inner side portion 25. Each opening 99 is, typically, flush with the outer surface of bottom portion 43. Openings 101, each of which include louvered covers 103 are positioned above the top surface of refractory brick 65 several inches to prevent blockage by, for instance, wood ash.

To create a plenum chamber 105 an arcuate skirt (not shown) of, for instance, metal lath and plaster, is wrapped around the front of legs 54 to create a chamber 105 defined by bottom 43, floor 107 and, for instance, dry wall 85. A vent pipe 109 passes through the dry wall 85 to the outside to provide outside air.

Figure 5:
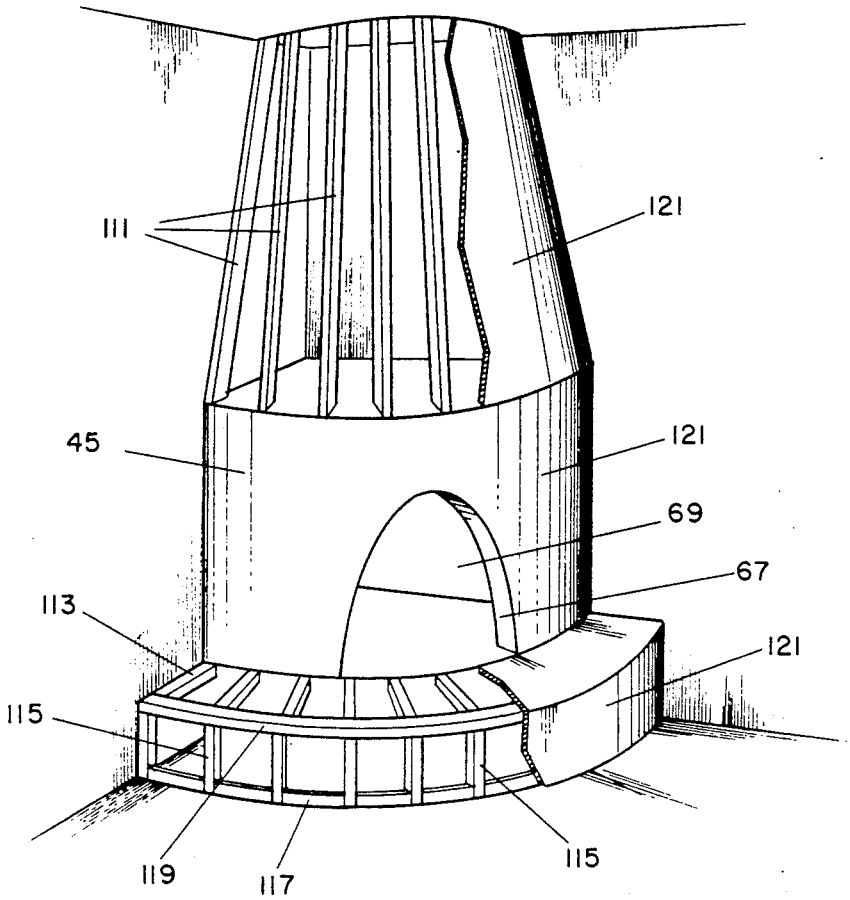
FIG. 5 is a perspective view of the firebox of FIG. 1 illustrating the use of non-combustible building materials to, in conjunction with the firebox, form the exterior frame of the fireplace.

With reference to FIG. 5, metal framing members 111, 113, 115, 117 and 119 are used, in conjunction with outer portion 45 of shell 15 to form the framing for the exterior of the fireplace. As shell 15 is formed of sixteen gauge steel, or similar material, the metal framing members can easily be attached by, for instance, sheet metal screws. After the desired framing is complete, members 111, 113, 115, 117 and 119 may be covered with wire lathing and then plaster, such as indicated by 121 in FIG. 5. Again, the design of shell 15 facilitates the attachment of wire lathing to the surface of 45. To assist in the plastering, a plaster ground in the form of a metal lip 123, as illustrated in FIG. 3, is provided. To the surface of plate 67 a ceramic blanket one inch thick with a rating of 1000° Fahrenheit, covered by wire lath, is attached by sheet metal screws. This arrangement facilitates plastering and, at the entrance to the combustion chamber 12, avoids direct contact between the firebox and the plaster to prevent the plaster from cracking as inner shell 13 expands because it is heated by a fire in the combustion chamber 12. Doors, not shown, can be attached to plate 67 thereby covering opening 69. The doors, as is common in the art, can be solid or can include a damper to control air flow.

Figure 6:
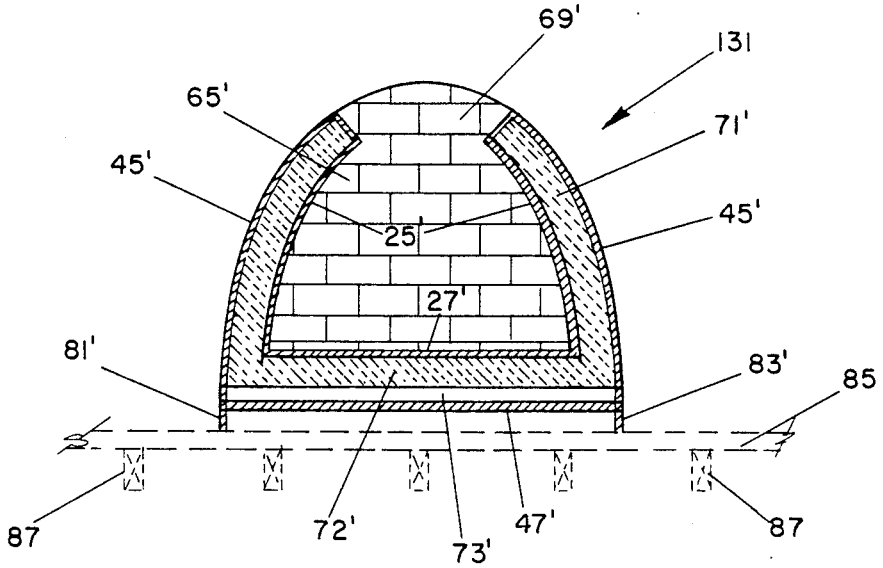
FIG. 6 is a front view of a firebox with an alternate configuration.

FIG. 6 discloses an alternate firebox 131 having a semi-circular or semi-elliptical base. As the components of firebox 131 are essentially the same and have the same function as those of firebox 11, the same parts are designated with similar numbers, i.e., 13', 15', etc.

Whereas the drawings and accompanying description have shown and described the preferred embodiments of the present invention, it will be apparent to those skilled in the art that various changes may be made in the form of the invention without effecting the scope thereof.

What I claim is:

1. A zero-clearance firebox for use in building a fireplace, said firebox comprising:

(a) only two metal shells, an inner shell and an outer shell, (i) said inner shell having an inner surface which defines the combustion chamber of said firebox, said inner shell having top, bottom and first and second side portions, said inner top portion having a first opening therein for a flue, said first side portion having a second opening therein, and (ii) said outer shell having an outer surface defining the exterior of said firebox, said outer shell having top, bottom and first and second side portions surrounding, respectively, said top, bottom and first and second side portions of said inner shell to define a space therebetween, said outer top portion having a third opening therein in alignment with said first opening, said first outer side portion having a fourth opening aligned with said second opening, to form a firebox opening;

(b) at least one solid insulating material positioned between said second inner side portion and said second outer side portion whereby those portions of said outer surface defined by second outer side portion may, during installation of said firebox, be placed in contact with one or more walls of a room in which said firebox is being installed;

(c) means for connecting said inner shell to said outer shell, said means closing said space between said inner and outer shells to the outside environment;

(d) a plurality of solid insulating materials positioned between said top portion of said inner shell and said top portion of said outer shell comprising a thermal ceramic blanket and rigid insulating fiber, said insulating materials maintaining said top portion of said outer shell at approximately, room temperature when a fire is maintained in said combustion chamber; and (e) a plurality of solid insulating materials positioned in proximity of said bottom portion of said inner shell and said bottom portion of said outer shell comprising a layer of thermal ceramic blanket, and a layer of refractory brick, said insulating fiber and said ceramic blanket positioned between said bottom portion of said inner shell and said bottom portion of said outer shell, said brick positioned on said bottom portion of said inner shell, said insulating materials maintaining said bottom portion of said outer shell at, approximately, room temperature when a fire is maintained in said combustion chamber;

(f) insulating material positioned between said first inner side portion and said first outer side portion comprising a thermal ceramic blanket and a closed volume of air.

2. The firebox of claim 1, wherein, insulating material is positioned between said first inner side portion and said first outer side portion.

3. The firebox of claim 2 wherein said insulating material positioned between said first side portion of said inner shell and said first side portion of said outer shell further comprises a thermal ceramic blanket.

4. The firebox of claim 3, wherein, said thermal ceramic blanket has a density of eight pounds and a maximum operating temperature of 2400 Fahrenheit.

5. The firebox as set forth in claim 3, wherein said first outer side portion further comprises means to permit attachment of materials to said exterior surface to form a finished fireplace.

6. The firebox of claim 3 further comprising means for admitting outside air to said combustion chamber through at least one conduit opening through said bottom portions of said outer and inner shells.

7. The firebox of claim 1 wherein, in cross section, said first side portion of said outer shell is arcuate, and said first portion of said inner shell is also arcuate.

* * * * *